United States Patent [19]

Knight

[11] Patent Number: 4,709,715

[45] Date of Patent: Dec. 1, 1987

[54] RETRACTABLE PRE-RINSE UNIT WITH AUTOMATIC SHUTOFF

[75] Inventor: Silsby H. Knight, New Tripoli, Pa.

[73] Assignee: Hayes-Ivy Manufacturing Inc., New Tripoli, Pa.

[21] Appl. No.: 828,402

[22] Filed: Feb. 11, 1986

[51] Int. Cl.[4] ..... B08B 3/00; B05B 15/08

[52] U.S. Cl. ..... 134/172; 239/576; 239/588; 137/616.5

[58] Field of Search ..... 134/172, 178, 180, 198; 239/576, 587, 588; 137/616.5; 251/244, 262, 263

[56] References Cited

U.S. PATENT DOCUMENTS

| | | | |
|---|---|---|---|
| 1,187,125 | 6/1916 | Barnes | 239/576 X |
| 1,621,905 | 3/1927 | Russell | 137/616.5 X |
| 1,709,245 | 4/1929 | Adams | 137/616.5 X |
| 1,714,232 | 5/1929 | Morris | 239/588 X |
| 2,853,262 | 9/1958 | Reimann | 239/588 X |
| 2,971,520 | 2/1961 | Motis et al. | 134/172 |

*Primary Examiner*—Louis K. Rimrodt
*Assistant Examiner*—J. L. Olds
*Attorney, Agent, or Firm*—Sughrue, Mion, Zinn, Macpeak & Seas

[57] ABSTRACT

A pre-rinse unit incorporates a normally closed water shutoff valve connected to the lower end of a vertical riser pipe carrying a source of water. An outer tube is rotatably and longitudinally slidable on the riser pipe. A pair of rotatable arms are mounted for rotation at one end to the upper end of the vertical riser pipe above the outer tube for rotation about a horizontal axis and the arms carry cams contacting a cam follower ring whose lower surface abuts the outer tube. A concentric coil spring surrounding the vertical riser pipe and interiorly of the hollow tube, abuts a lower collar fixed to the riser pipe, interiorly of the tube, at its lower end and its upper end abuts the cam follower ring. Stop means carried by the riser pipe limits pivoting of the arms. At the outboard end of the arms, a hollow sleeve fixed to the arms at right angles thereto slidably receives a flexible hose connected at one end to the upper end of the riser pipe, whose opposite end bears a urethane foam insulated handle and spray head assembly. A set screw carried by the sleeve adjustably locks the hose to the arms and determines the vertical height position of the spray head. A cam fixed to the lower end of the hollow tube contacts a cam follower on a pivotable lever having an end remote from the cam follower which bears on a spring biased plunger of the shutoff valve to automatically open the shutoff valve in response to downward movement of the outer tube upon rotation of the paired arms by pull down of the handle and spray head assembly. Automatic termination of water supply occurs upon release of the handle and spray head assembly and reverse rotation of said paired arms.

9 Claims, 3 Drawing Figures

RETRACTABLE PRE-RINSE UNIT WITH AUTOMATIC SHUTOFF

FIELD OF THE INVENTION

This invention relates to retractable pre-rinse units for pre-rinsing dishes and cooking utensils within commercial restaurants or the like and more particularly to a retractable pre-rinse unit which includes an automatic means for shutting off the water supply upon release of the handle housing the water spray nozzle.

BACKGROUND OF THE INVENTION

In restaurants or the like, it is common to employ a pre-rinse unit for rinsing dishes or cooking utensils prior to their placement within industrial dishwashers. U.S. Pat. No. 2,971,520 to Motis et al issuing Feb. 14, 1961, and U.S. Pat. No. 2,853,262 to Reimann issuing Sept. 23, 1958 are exemplary of such pre-rinse units. In U.S. Pat. No. 2,971,520, the unit is neither retractable nor does it have an automatic shutoff. In U.S. Pat. No. 2,853,262, there is no automatic shutoff but the unit includes an arcuate spring strip supporting a flexible hose in an arcuate, semi-loop form coupled at one end to a vertical riser pipe bearing the water for spraying. The opposite end of the hose extends downwardly, to one side of the riser pipe, and terminates in a spray head integrated with a normally closed shutoff valve. This prevents water spray unless the operator grasps a valve actuator adjacent to the tubular hand grip or handle interposed between the end of the hose and the spray nozzle itself. By pivoting the actuator in the direction of the grip, the normally closed valve opens and a downward spray emanates from the spray head for cleansing the dishes. In both cases, the pre-rinse unit mounts the flexible hose for rotation about the axis of the riser pipe. To shift the unit spray head into spray position or away from the area of spraying, rotation of the assembly mounted to the upper end of the riser pipe is effected, about the vertical axis of that pipe.

Attempts have been made to incorporate within such pre-rinse units, a mechanism for automatically turning on the water when the hand grip at the end of the flexible hose is grasped and moved downwardly towards the underlying dishes at the work station and to permit the water supply to be automatically turned off upon release of the hand grip which rises upwardly at the work station.

The T&S Brass and Bronze Works, Inc. of Newcastle, N.Y. assignees of U.S. Pat. No. 2,853,262, has had a retractable pre-rinse unit in commercial production for years based on the principles within that patent which has become the industry standard. Their current model, B-113, is characterized by a deck faucet with under sink mixing spreader, a spring action goose-neck differing somewhat in structure but operating functionally in accordance with U.S. Pat. No. 2,853,262, a hot and cold mixing faucet at the lower end of the vertical riser pipe, and built-in check valves. Recently, T&S Brass and Bronze Works, Inc. has introduced a new model under the trade designation B-114 which utilizes a "rotor-flex" swivel joint assembly which replaces the spring action goose neck and which functions to automatically retract the spring valve.

While such units have a certain amount of trade acceptance, the units have a large number of moving parts, leaks may be developed at the swivel joints due to the number of moving parts and the units are relatively expensive to repair. Further, in an attempt to improve the model B-114, T&S added a thermostatic control valve therein, and a ball valve. The ball valve constitutes an additional, if not a main wear point, it is difficult to replace the same requiring complete disassembly to achieve that end.

It is, therefore, a primary object of the present invention to provide an improved retractable, pre-rinse unit which is devoid of leaks, which may be swiveled through 180° at the work station, which incorporates an automatic shut off valve at the lower part of the vertical riser pipe constituting the base element of the assembly which eliminates leaks, which has relatively few parts, which may be manufactured at low cost and in which the spray height is readily adjustable for convenience of the operator without comprising normal desired travel or shifting of the spray head.

SUMMARY OF THE INVENTION

The present invention is directed to a retractable pre-rinse unit comprising a vertical tubular assembly consisting of an internal vertical riser pipe having upper and lower ends, an outer tube of a diameter in excess of that of said riser pipe and concentrically positioned thereon. A normally closed water shutoff valve is connected to said riser pipe at said lower end thereof for connecting to a source of water. Means are provided for mounting said outer tube concentrically on said vertical riser pipe above said shutoff valve for movement axially and for rotation about its axis on said riser pipe. A flexible hose is fixably connected at one end to the upper end of said riser pipe. A spray head is fixably coupled to the other end of said hose. Means is provided for supporting said hose in arcuate, semi-loop form with said spray head pointing downwardly, to the side of said tubular assembly, movable parallel to the vertical riser pipe and spaced laterally therefrom. Means spring bias said outer tube in a direction away from said valve. Stop means is carried by said vertical riser pipe for limiting vertical movement of said outer tube away from said valve. Means responsive to tube movement axially on said vertical riser pipe in the direction of said valve and against said spring bias means opens said normally closed valve. Cam means carried by said hose supporting means effects vertical movement of said tube on said riser pipe, against the bias of said spring bias means in response to pull down of said spray head to open said normally closed valve.

Said means for supporting said hose in a arcuate semi-loop form may comprise rotatable arm means pivotally coupled at one end in proximity to said outer tube on slidable means carried by said riser pipe, above the upper end of said outer tube, for rotation about a horizontal axis. Means adjustably couple an intermediate portion of the flexible hose to the other end of said arm means remote from the hose connection to the upper end of said vertical riser pipe. Said cam means carried by said pivotal arm means engage the upper end of said vertically displaceable outer tube for causing said tube to move downwardly against the bias of said spring bias means in response to pull down of said spray handle and pivoting of said arm means about the pivot axis thereof.

Said normally closed shutoff valve may comprise a spring biased plunger projecting outwardly of a valve casing coupled to the lower end of said vertical riser pipe. The lower end of said outer tube carries a cam. A cam follower on lever means mounted to said shutoff valve and engageable by said cam carried by said outer tube. Said lever means including means abutting said spring biased plunger for depressing said plunger and opening said normally closed shutoff valve, in response to movement of said outer tube cam relative to said follower means.

A first, fixed lower collar may be fixed to said vertical riser pipe, interiorly of said outer tube above said shutoff valve. A second, upper fixed collar may be fixed to said vertical riser pipe at the upper end thereof, below the connection between the upper end of said vertical riser pipe and said flexible hose. A vertical slidable bushing may be slidably mounted on said vertical riser pipe and positioned beneath said upper fixed collar. Means rotatably mount said arms means to said slidable bushing for rotation about a horizontal axis. A follower ring is positioned on the upper end of said outer tube, concentrically about said riser pipe said follower ring having an upper surface bearing against said cam means carried by said pivotal arm means. Said spring means may comprise a compression coil spring concentric about the inner vertical riser pipe having one end abutting said lower fixed collar and having the other end directly abutting said follower ring whereby said follower ring functions as a cam follower. The follower ring abuts directly the upper end of said outer tube to drive the outer tube downwardly against the spring bias in response to rotation of the arm means upon pulling of said spray head downwardly to effect vertical lowering of the cam carried at the bottom of said outer tube and bearing on said cam follower for opening said normally closed water shutoff valve.

Said bushing slidably mounted on the inner vertical riser pipe may have a transverse bushing welded thereto, at right angles and to one side thereof, and said transverse bushing supports a horizontal pivot pin mounted for rotation about its axis and fixably coupled to said arm means. Said arm means may comprise a pair of laterally spaced, parallel arms, mounted to respective ends of said pivot pin, to the sides of said slidable bushing and extending across opposite sides of said vertical riser pipe.

Said arms at the ends opposite their pivot connection to said bushing carried pivot pin, may fixedly carry a tubular sleeve at right angles to said arms. Said hose passes therethrough and said sleeve includes a set screw for clamping said hose, at a given location, to said arms so as to vary the vertical position of said spray head upon manual release of the same and rotation of said arms under said spring bias to a position where said spray head is lifted above the area of its normal use, with the shutoff valve closed, and above the height where water spray is initiated during spray head pull down. A bracket fixably coupled to said slidable bushing and interposed between said arms and said outer tube extends upwardly and carries a stop for limiting rotation of said arms under the spring bias in a direction to raise the spray head. Said stop is at a position such, that with the arms rotated into abutment with said stop means, said shutoff valve spring biased plunger shifts to valve normally closed position.

DESCRIPTION OF THE PREFERRED EMBODIMENT

Figure 1:
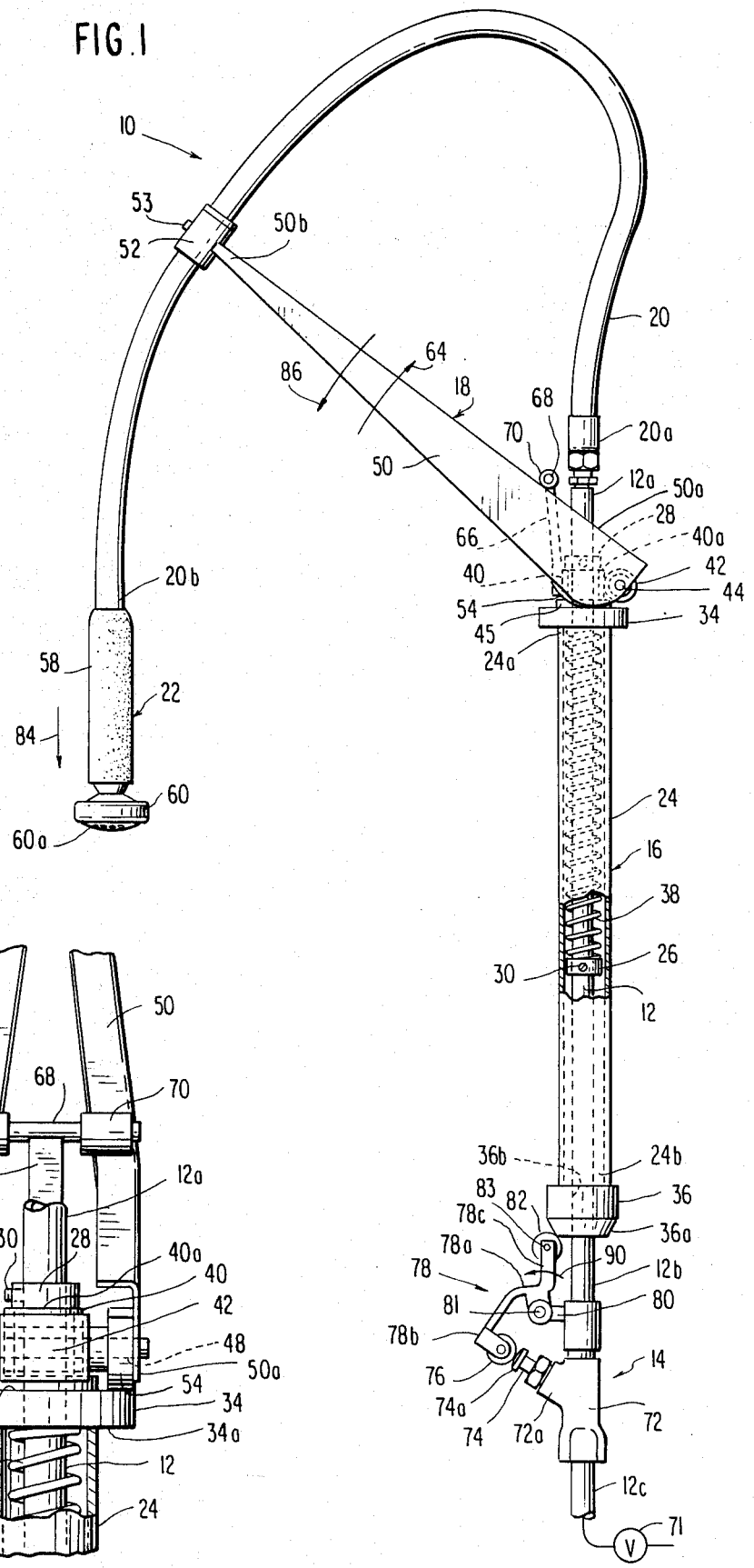
FIG. 1 is a side elevational view, partially in section, of the retractable pre-rinse unit with automatic shutoff forming a preferred embodiment of the invention showing the spray head in released, raised position with the shutoff valve closed as a result thereof.

Referring to the drawings, typically the rinsing device of the present invention, and indicated generally at 10, for supplying rinse water, is mounted vertically to a trim table (not shown). It includes a vertical, water supply or riser pipe 12 which normally extends vertically upward from the trim table, and adjacent a sink (not shown). Such rinse water may contain a detergent if desired. The vertical riser pipe 12, in the illustrated embodiment, is connected directly to and rises from a normally closed shutoff valve indicated generally at 14 and which functions to shutoff the flow of rinse water through the unit for spray removal of food waste from dishes or the like at the trim table.

Figure 3:
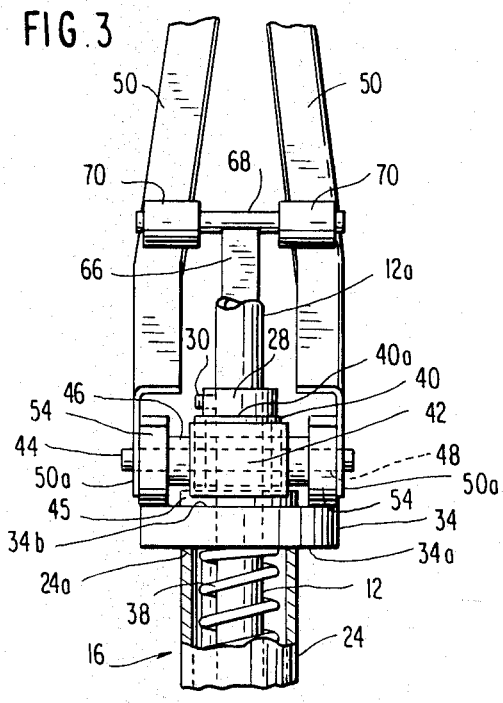
FIG. 3 is a rear elevational view thereof.

In addition to the shutoff valve 14, the unit 10 comprises principally, a tubular assembly 16, a pivotal arm assembly or means 18, a flexible hose 20 and a urethane foam insulated handle and spray head assembly indicated generally at 22. The tubular assembly 16 is comprised of the vertical riser pipe 12 and a concentric outer tube 24. The inside diameter of the outer tube 24 is somewhat larger than the outside diameter of riser pipe 12 so that there is an annular space therebetween. Also, the riser pipe 12 is of a length considerably longer than the outer tube 24 such that the upper end **12*a* of the riser pipe extends outwardly of the concentric outer tube 24. Further, fixably mounted to the riser pipe 12, via set screws 30, are a pair of collars; a lower collar 26 and an upper collar 28. A plastic follower ring or annulus 34 is slidably and freely rotatably positioned on the upper end 24*a* of the outer tube 24. Fixably mounted to the lower end 24*b* of the outer tube is an annular plastic cam 36 which is of modified cylindrical form, bearing a bevel cam face surface 36*a* on its lower end. The cam 36 has an axial hole 36*b*, therein sized slightly larger than the inner pipe 12 upon which it slides. Concentrically positioned about the inner, vertical riser pipe 12, interiorly of the outer tube 24, is a compression coil spring 38. The lower end of coil spring 38 abuts the lower fixed collar 26 while the upper end of the coil spring abuts the bottom 34*a* of a cam follower ring 34. Ring 34 has a hole therein which is sized slightly larger than the diameter of the inner pipe 12. The bottom 34*a* of ring 34 abuts the upper end 24*a* of the outer tube 24. Bottom 34*a* also abuts the upper end of compression coil spring 38. As may be best appreciated by reference to FIG. 3, a bushing 40 is slidably mounted concentrically on the inner riser pipe 12. Bushing 40 has an upper end 40*a* which abuts fixed collar 28. The lower end of bushing 40 contacts a plastic washer 45 which freely abuts the upper face 34*b* of cam follower ring 34. Additionally, in accordance with FIG. 3, a further tubular transverse bushing 42 is welded to the outside of the vertically slidable bushing 40, with its axis horizontal. The bushing 42 rotatably mounts a pivot pin or axle 44 by way of a TEFLON sleeve 46. Sleeve 46 is interposed within the bushing 42, and axially receives the pivot pin or axle 44. The ends of the axle extend outwardly of the sleeve 46 and pass through holes 48 within the inboard ends 50*a* of a pair of pivot arms 50 of arm means 18. The arms are of modified triangular shape and their narrowed, outboard ends 50*b* meet and are welded to a tubular bushing or sleeve 52, at right angles thereto. As such, the arms 50 pivot about a horizontal pivot axis defined by the pivot pin 44. The lower corners of arms 50, at their inboard ends 50***a*, are rounded so as to integrally form cams 54, although the cams may be separately formed and welded or otherwise fixably attached to the arms 50. Cams 54 bear on the top 34*b* of cam follower ring 34 and in turn being in contact with the spring biased outer tube 24 forces the tube 24 to follow the movement of the cam follower ring 34.

Further, as may be appreciated, the coil spring 38, through ring 34 maintains the slidable bushing 40 in contact with the fixed upper collar 28, through washer 45, by maintaining the follower ring 34 in contact with the cams 54 on opposite sides of the vertical riser pipe 12. Pipe upper end 12*a* extends upwardly and between arms 50. The hose 20 is sealably connected at 20*b* to upper end 12*a* of the riser pipe and is in fluid connection with the pipe. The flexible hose 20 extends through the bushing or sleeve 52 and is sized slightly smaller than the interior diameter of that bushing so as to be slidably adjustably positionable within sleeve 52. A set screw 53 is threaded within a radially tapped hole within the sleeve 52 so as to frictionally lock the hose 20 at a given position, to the sleeve. This permits adjustment in the vertical height position of the urethane foam insulated handle and spray head assembly 22. The end 20*b* of the flexible hose 20, remote from its connection at end 20*a* to the upper end of the fixed vertical riser pipe 12*a*, is sealably connected to the handle and spray head assembly 22. In that respect, assembly 22 is comprised principally of a urethane foam insulated hollow handle 58 and a hollow spray head 60. The spray head 60 bears a perforated face 60*a*, permitting water to discharge in spray form as at 62. The arcuate movement of the arm means or assembly 18 is limited so that while the handle and spray head assembly 22 may be released allowing it to rise several feet above its normal use position and out of the way of personnel in the vicinity of the trim table, the unit includes positive stop means for limiting that upward movement resulting from clockwise rotation of arms 50, FIGS. 1 and 2.

In that respect, the follower ring 24 is provided with a vertical bracket 66 which rises vertically upward and lies intermediate of the arms 50. By reference to FIG. 3, it may be seen that the bracket supports a horizontally extending rod 68 each end of which bears a rubber sleeve or bumper 70 about the periphery thereof in the path of the upper edges 50*a* of arms 50 so that these edges 50*a* come into contact with rubber bumpers 70 defined thereby to prevent further clockwise rotation of arms 50. The vertical height of the bumpers 70 above the upper surface 24*b* of the follower ring 24 is predetermined in conjunction with the configuration given to cams 54 so as to insure that upon arm clockwise rotation to the extent where edges 50*a* of the arms 50 abut the bumpers 70, constituting the stop means for the arms 50, the normally closed shutoff valve 14 is indeed closed to prevent inadvertent spraying of water when use of the unit is terminated.

In that respect, the shutoff valve 14 is composed of a vertical tubular housing 72 connected at its top to the lower end 12*b* of the riser pipe 12 and at its bottom to a further vertical riser pipe section 12*c*, which section 12*c* may be connected directly to a source of water or through a base mixing faucet 71 for controlling the temperature of the water supplied and for mixing hot and cold water supplies leading to the singular vertical riser pipe 12. Housing 72 is provided with a upwardly oblique branch section 72*a* which supports a spring biased plunger 74 whose headed end 74*a* projects outwardly of branch section 72*a*. End 74*a* is in abutment with a ball or sphere 76 of a valve actuator or lever, indicated generally at 78. Housing 72 further includes a valve actuator or lever support member 80 which projects radially outwardly of the tubular housing 72, at its upper end, and which pivotally supports lever 78, intermediate of its ends. Lever 78 may be of Z shape with a central portion 78*a* pivotally mounted by way of pin 81 to the shutoff valve housing 72. The lever 78 includes a lower or bottom leg 78*b* bearing the ball or sphere 76 which abuts the headed end 74*a* of the spring biased plunger 74. Lever 78 terminates in an upper leg 78*c* at whose end mounts cylindrical cam follower 82 for rotation about its horizontal axis on pin 83. The cam follower 82 is positioned so as to be impacted by the oblique or beveled cam surface 36*a* of cam 36.

Figure 2:
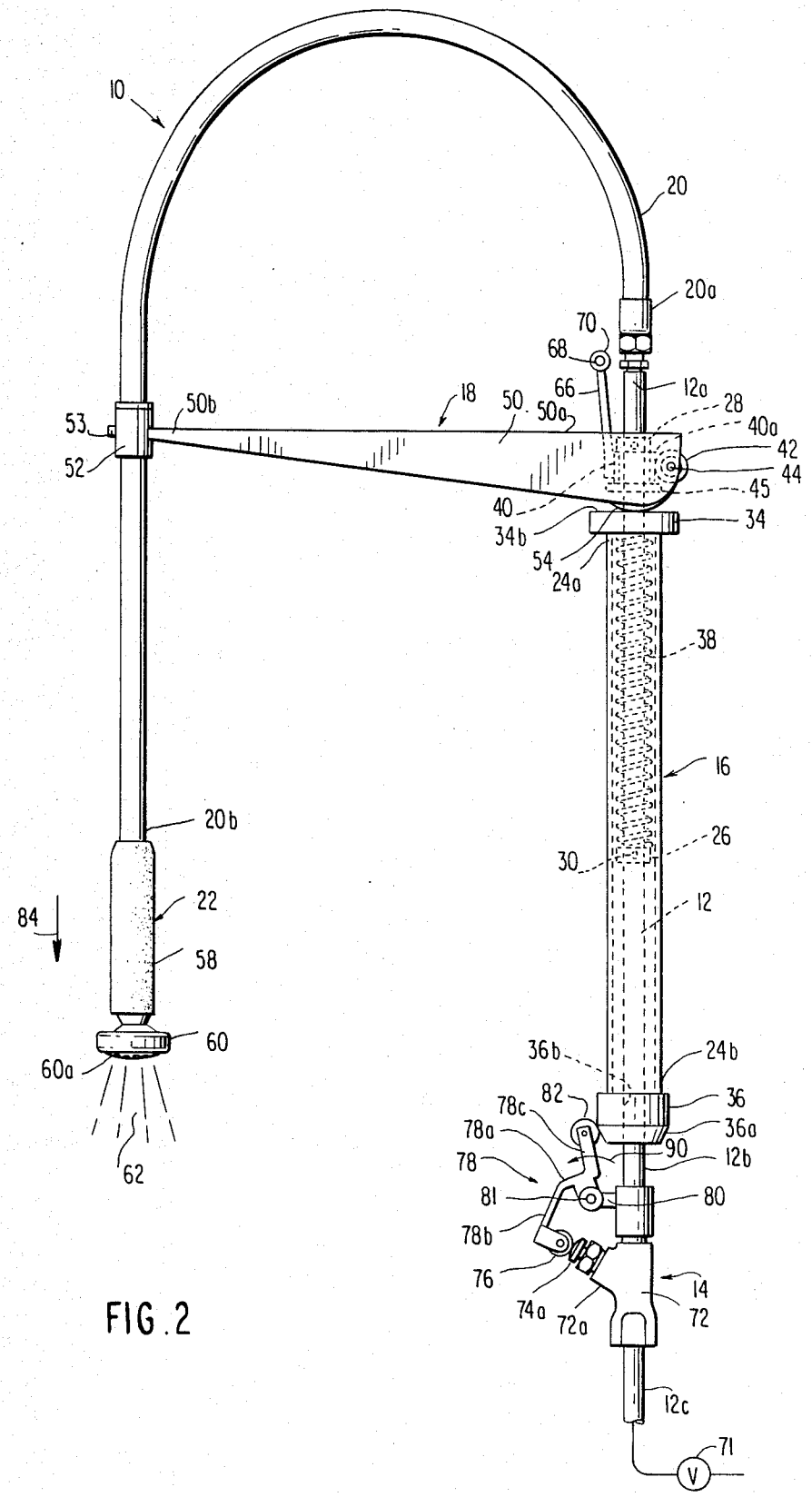
FIG. 2 is a side elevational view of the unit of FIG. 1 similar to that of FIG. 1 under spary operation and shutoff valve open conditions.

The operation of the unit is believed to be understood from the foregoing discussion. As seen in FIG. 1, the unit 10 is in shutoff condition with the handle and spray head assembly 22 in vertically raised position well above the operating position, relative to the trim table. By manually pulling downwardly as indicated by arrow 84 on the urethane foam insulated handle 58 surrounding tube 59 connecting end 20*b* of the hose to spray head 60, the arms 50 rotate counterclockwise as indicated by arrow 86. The result of this is to cause the cams 54 of arms 50 to depress the cam follower ring 34 against the bias of coil spring 38 which forces the outer tube 24 to move downwardly. This rocks the valve actuator or lever 78 counterclockwise about its horizontal pivot axis defined by pin 81, as indicated by arrow 90, forcing the sphere or ball 76 to depress the spring biased plunger 74 to open the normally closed shutoff valve 14. Water then sprays from the head 22 as indicated at 62, FIG. 2. Upon termination of rinsing of one or more utensils or plates, the operator releases his grasp from the urethane foam insulated handle 58 allowing the coil spring 38 to expand slightly and to rotate arms 50 as indicated by arrow 64 to the position as shown in FIG. 1, at which the upper edges 50*a* of the arms 50 abut bumpers 70*a*. In this position, the cam 36 fixed to outer tube 24 is raised vertically, back to the position shown in FIG. 1, to the extent where ball 76 rests lightly upon headed end 74*a* of the spring biased plunger of the shutoff valve 14, the plunger is projected by its spring bias and the shutoff valve is in its normally closed position.

Further, from the above, it is apparent that the tube 24 is mounted for free axial movement as well as limited rotary movement, i.e., the tube 24 can swivel 90° degrees from each side of center to permit the person operating the unit to shift the handle and spring head assembly 22 through 180° and to either side, as desired. The tubular nature of the cam 36, preferably with conical cam face 36*a*, permits this action. Further, advantageously, the cams 54 on the lower corner of the arms 50 are purposely made of slightly different radii so that one cam surface contacts the follower ring 34 prior to the other to cause a slight rotary shifting of the follower ring 34 each time the unit is actuated and to thus distribute the wear on that member evenly over top surface 34*b* of the follower ring. The follower ring 34, the cam 36, bushing sleeve 46, and washer 45 may be formed of a low friction plastic material such as DELRIN or the like. The same may be true for follower 82 and sphere or ball 76 mounted to opposite ends of lever 78. The major components other than these parts may be formed of sheet metal, metal tube or pipe stock, or the like. The shutoff valve 14 is of standard commercial design, as is spray head 60. The flexible hose 20 may be of the type shown in the cited patents.

The unit 10 is characterized by a low initial cost. Purposely the shutoff valve 14 is mounted at a low but accessible position and functions to shut off the flow of water at the closest possible connection to the water supply, to minimize leakage of the unit 10. Standard commercially available parts are preferably employed in critical wear areas and the number of parts are relatively few in comparison with known pre-rinse units. Preferably the metal parts are of stainless steel with acetal wear parts in critical areas. With the bushing 54 permitting adjustable connection of the hose 20 on arm 50, the spray head 60 height may be adjusted for convenience of the operator while maintaining normal travel and permitting a full 180° swivelling of the assembly. The unit eliminates problems conventionally occurring using available pre-rinse units, reducing hose and valve wear and eliminating the problems of the operator possibly burning his hands. Further, absent the automatic shutoff mechanism of the present invention, such pre-rinse units which do not turn themselves off by themselves, result in the hose sometimes splitting due to heat, as in the middle of the night flooding the kitchen and causing significant water damage.

While the invention has been described in detail and with reference to particular embodiments thereof, it will be apparent to one skilled in the art that changes and modifications can be made thereto without departing from the spirit and scope of the invention.

What is claimed is:

1. A retractable pre-rinse unit comprising a vertical upright tubular assembly comprising a fixed vertical internal riser pipe having upper and lower ends, an outer tube of a diameter in excess of that of said riser pipe, a normally closed water shutoff valve connected to said internal riser pipe at the lower end thereof for connecting to a source of water, means for mounting said outer tube concentrically on said vertical riser pipe above said shutoff valve for movement axially and for rotation about its axis on said riser pipe, a flexible hose fixably connected at one end coaxially to the upper end of said riser pipe, a spray head fixably coupled to the other end of said hose, means rotatably mounted to the upper end of said fixed vertical internal riser pipe for supporting said hose in arcuate, semi-loop form with said spray head pointing downwardly and to a side of said tubular assembly for raising and lowering said spray head parallel to said vertical upright tubular assembly and being spaced laterally therefrom, spring biasing means mounted externally of said internal riser pipe and operatively engaging said outer tube for biasing said outer tube upwardly away from said valve, stop means carried by said vertical riser pipe for limiting vertical movement of said outer tube away from said valve, means responsive to outer tube movement axially on said vertical internal riser pipe toward said shutoff valve and against said spring biasing means for opening said normally closed shutoff valve, and cam means carried by said hose supporting means and operatively engaging said outer tube for effecting vertical movement of said outer tube on said riser pipe against the bias of said spring biasing means in response to manual pull down of the spray head to open said normally closed valve.

2. The pre-rinse unit as claimed in claim 1, wherein said means for supporting said hose in an arcuate, semi-loop form comprises rotatable arm means for rotation about a horizontal axis on said internal riser pipe and above the upper end of said outer tube, and means coupling said flexible hose at a longitudinal adjustable position to the other end of said arm means remote from the hose connection to the upper end of said vertical riser pipe and wherein said cam means are carried by said rotatable arm means and operatively engage the upper end of said vertically displaceable outer tube for causing said outer tube to move downwardly against the bias of said spring biasing means in response to pull down of said spray handle to effect pivoting of said arm means about the pivot axis thereof.

3. The pre-rinse unit as claimed in claim 1, wherein said normally closed shutoff valve comprises a spring biased plunger projecting outwardly of a valve casing coupled to the lower end of said vertical riser pipe, the lower end of said outer tube fixably carrying cam means, lever means mounted to said shutoff valve for pivoting thereon, said lever means including a cam follower, said lever means cam follower being positioned in the path of said outer tube carried cam and said lever means including means abutting said spring biased plunger for depressing said plunger and opening said normally closed shutoff valve in response to vertically downward movement of said outer tube against the bias of said spring biasing means.

4. The pre-rinse unit as claimed in claim 2, wherein said normally closed shutoff valve comprises a spring biased plunger projecting outwardly of a valve casing coupled to the lower end of said vertical riser pipe, the lower end of said outer tube fixably carrying cam means, lever means mounted to said shutoff valve for pivoting thereon, said lever means including a cam follower, said lever means cam follower positioned in the path of said tube carried cam and said lever means including means abutting said spring bias plunger for depressing said plunger and opening said normally closed shutoff valve in response to vertically downward movement of said outer tube against the bias of said spring biasing means.

5. The pre-rinse unit as claimed in claim 2, wherein, a first, lower collar is fixed concentrically on said vertical riser pipe, interiorly of said outer tube and above said shutoff valve, a second, upper collar is concentrically fixed on said vertical riser pipe at the upper end thereof, below the connection between the upper end of said vertical riser pipe and said flexible hose, a bushing is concentrically, slidably mounted on said vertical riser pipe beneath said fixed upper collar, means are carried by said slidable bushing for mounting said rotatable arm means for rotation about a horizontal axis, a cam follower ring is slidably positioned concentrically about said riser pipe, above said outer tube and having an upper surface operatively contacting said cam means carried by said pivotal arm means and against the bottom of said vertically slidable bushing such that the second upper collar acts as a stop for limiting upward movement of said outer tube and said cam follower ring and maintains said cam follower ring in contact with said cam means carried by said arm means, whereby, manual pull down of said spray head causes rotation of said arm means, whose cam means vertically depresses said cam follower ring and said outer tube against said spring biasing means.

6. The pre-rinse unit as claimed in claim 5, wherein said spring biasing means comprises a compression coil spring concentric about the internal, vertical riser pipe and interiorly of said outer tube and compressed directly between said lower fixed collar and said cam follower ring, such that with said cam follower ring abutting the upper end of said outer tube, said cam follower ring drives the outer tube downwardly against the spring bias of said compression coil spring in response to rotation of said arm means to effect vertical lowering of a cam fixably mounted to the lower end of the outer tube and and bearing on a lever mounted cam follower for opening said normally closed water shutoff valve.

7. The pre-rinse unit as claimed in claim 5, wherein said vertically slidable bushing mounted concentrically on the vertical internal riser pipe has a transverse bushing welded thereto at right angles and to one side thereof, an axle projects through said bushing for rotation about a horizontal axis, said rotatable arm means comprises a pair of laterally spaced, parallel arms projecting across opposite sides of said vertical riser pipe and being mounted respectively at one of their ends to respective ends of said axle.

8. The pre-rinse unit as claimed in claim 2, wherein said means for coupling said flexible hose to said arms means remote from said vertical riser pipe comprises a tubular sleeve fixed to said arm means at right angles to said arm means, said hose slidable passes through said tubular sleeve, and means carried by said sleeve for clamping said hose at a longitudinally adjustable position to sleeve so as to vary the vertical height position of the spray head.

9. The pre-rinse unit as claimed in claim 6, further comprising a bracket fixably mounted to said vertically slidable bushing, rising upwardly therefrom and interposed between a pair of laterally spaced, parallel arms adjacent said vertical riser pipe forming said rotatable arm means, and stop means carried by said bracket and operatively engaging said pair of laterally spaced, parallel arms for limiting rotation thereof by said spring biasing means in a direction to raise said spray head, and wherein said stop means is positioned such that the arms rotated against said stop means, a shutoff valve spring biased plunger of said valve is shifted to valve normally closed position.

* * * * *